United States Patent [19]

Stahlecker

[11] Patent Number: 5,027,476

[45] Date of Patent: Jul. 2, 1991

[54] BEARING AND LOADING ARM FOR DRAFTING UNITS

[75] Inventor: Hans Stahlecker, Süssen, Fed. Rep. of Germany

[73] Assignee: Maschinenfabrik Altstatten AG, Fed. Rep. of Germany

[21] Appl. No.: 365,857

[22] Filed: Jun. 15, 1989

[30] Foreign Application Priority Data

Jul. 14, 1988 [DE] Fed. Rep. of Germany ..... 3823872

[51] Int. Cl.[5] ..... D01H 5/50

[52] U.S. Cl. ..... 19/281; 19/279; 19/277

[58] Field of Search ..... 19/277, 279, 280, 281, 19/282, 295

[56] References Cited

U.S. PATENT DOCUMENTS

| | | | |
|---|---|---|---|
| 2,819,497 | 1/1958 | Dausch | 19/279 |
| 3,278,994 | 10/1966 | Stahlecker et al. | 19/282 |

FOREIGN PATENT DOCUMENTS

| | | |
|---|---|---|
| 1099917 | 2/1961 | Fed. Rep. of Germany . |
| 1164289 | 2/1964 | Fed. Rep. of Germany . |
| 1560284 | 10/1970 | Fed. Rep. of Germany . |
| 1361626 | 4/1964 | France . |
| 361513 | 5/1962 | Switzerland . |
| 830614 | 3/1960 | United Kingdom . |

*Primary Examiner*—Werner H. Schroeder
*Assistant Examiner*—Michael A. Neas
*Attorney, Agent, or Firm*—Evenson, Wands, Edwards, Lenahan & McKeown

[57] ABSTRACT

In the case of a bearing and loading arm for drafting units having holding devices for pressure roller twins, which each contain a leaf spring, it is provided that the leaf spring, in loading direction and in longitudinal direction of the bearing and loading arm, is fixed in a spring retainer, and that the leaf spring supports itself directly at this bearing and loading arm, transversely with respect to the bearing and loading arm.

20 Claims, 1 Drawing Sheet

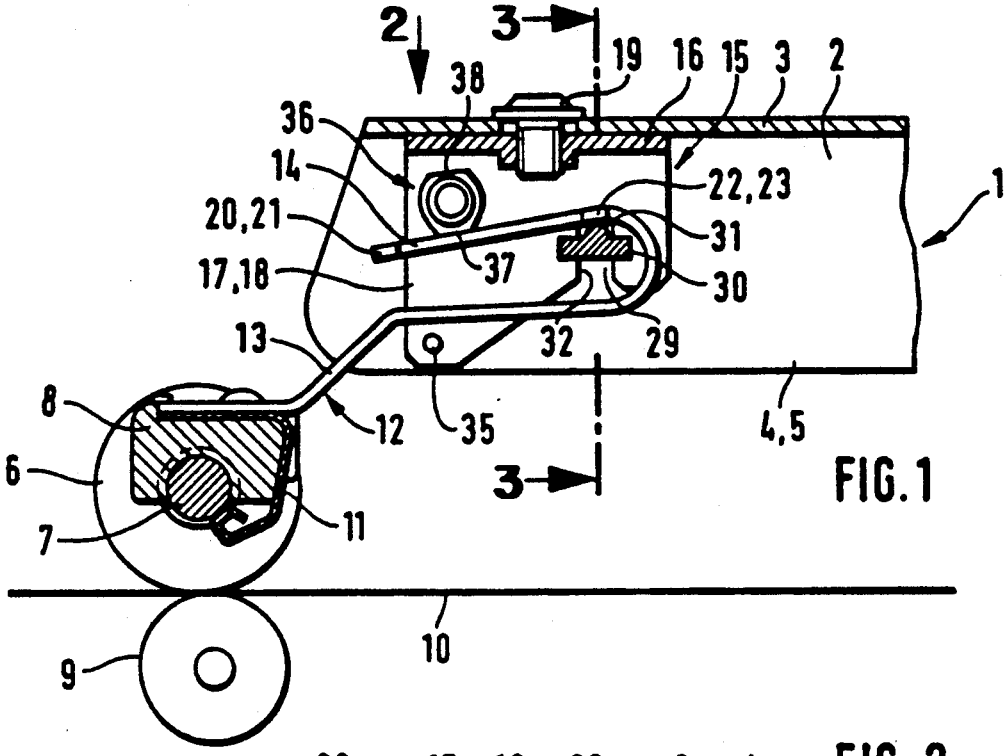
FIG. 1
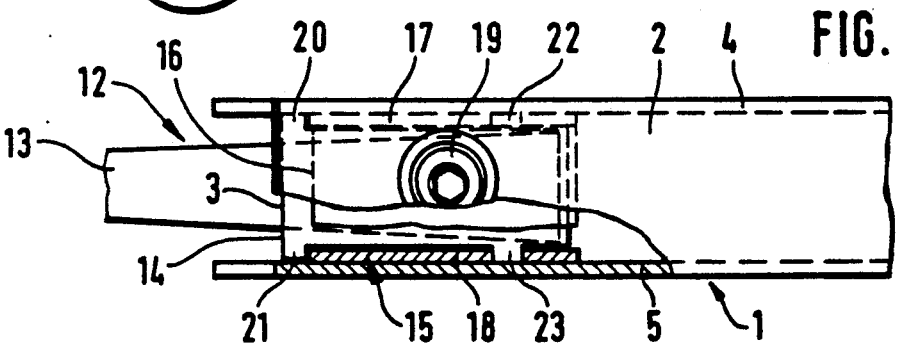
FIG. 2
FIG. 3
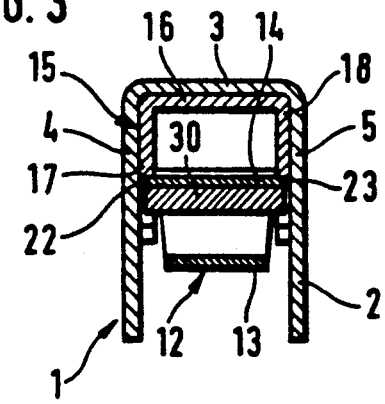
FIG. 4
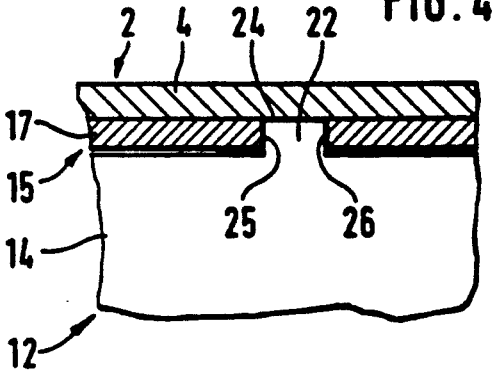

BEARING AND LOADING ARM FOR DRAFTING UNITS

BACKGROUND AND SUMMARY OF THE INVENTION

The invention relates to a bearing and loading arm for drafting units having holding devices for pressure roller twins, which each contain a leaf spring held at the bearing and loading arm by means of a spring retainer which is adjustable in longitudinal direction of the bearing and loading arm, this leaf spring bearing a receiving device for a shaft of the pressure roller twins.

In a known bearing and loading arm of this type described in German utility model (DE-GM) 19 09 951, the holding device has a slider which is used as the spring retainer is held by means of a screw at the bearing and loading arm and can be locked in the respective operative position. The leaf spring is fastened at this slider by means of an additional screw and, at its other end, has the receiving device for the shaft of the pressure roller twin. Between the spring retainer constructed as the slider and the leaf spring, a supporting plate is arranged, which is provided with a slot and can be shifted in longitudinal direction of the leaf spring, and by means of the shifting of which, the effective spring length can be adjusted. The danger exists in this known construction that the shaft of the pressure roller twin is not adjusted in parallel with respect to the pertaining bottom roller. It is possible for the leaf spring to carry out rotations around the screw which holds it at the spring retainer, and it is also possible that the spring retainer itself carries out movements around the screw connecting it with the bearing and loading arm.

An object of the invention is to develop a bearing and loading arm of the initially mentioned type such that the parallelism between the pressure roller twin and the pertaining bottom roller is ensured without any adjusting work.

This object is achieved according to the invention by aligning the leaf spring transversely to the longitudinal direction of the bearing and loading arm on guides.

By means of this construction, it is ensured that the leaf spring itself is aligned with respect to the guides so that adjustments at the spring retainer holding the leaf spring cannot result in a loss of parallelism.

In a further development of preferred embodiments of the invention, it is provided that the leaf spring is fixed in the spring retainer in loading direction and in longitudinal direction of the bearing and loading arm, and that the leaf spring supports itself transversely with respect to the bearing and loading arm directly at this bearing and loading arm. Since an adjustment is required only in longitudinal direction of the bearing and loading arm and possibly may also be required with respect to the loading, these adjustments may be carried out by means of the spring retainer. However, since the leaf spring is guided directly at the bearing and loading arm, these adjustments do not result in a changing of the position of the leaf spring in transverse direction with respect to the bearing and loading arm so that parallelism is maintained with a high degree of certainty without the requirement of having to take special measures for the adjusting of the spring retainer.

In a further development of preferred embodiments of the invention, it is provided that the receiving device for the shaft of the pressure roller twin, after the mounting of the leaf spring, is at least subjected to a finishing.

For this purpose, the receiving device is first mounted on the leaf spring, after which the leaf spring with the receiving device is inserted in an arrangement which corresponds to the holding device formed by the spring retainer and the bearing and loading arm and which is aligned precisely with respect to a tool which finishes the receiving device. In this position, the receiving device will then be gripped, held and finished. As a result, it is ensured that the recess of the receiving device, in which the shaft of the pressure roller twin will later be accommodated, is aligned precisely with respect to that area of the leaf spring by means of which it is supported at the spring retainer and later at a bearing and loading arm, without any perceptible occurrence of tolerances which may have been created in the spring as a result of manufacturing. These tolerances are all compensated by the subsequent finishing.

Other objects, advantages and novel features of the present invention will become apparent from the following detailed description of the invention when considered in conjunction with the accompanying drawings.

BRIEF DESCRIPTION OF THE DRAWINGS

FIG. 1 is a partial sectional view in longitudinal direction of a bearing and loading arm constructed according to a preferred embodiment of the invention;

FIG. 2 is a partially opened-up view of the bearing and loading arm of FIG. 1, taken in the direction of the Arrow II;

FIG. 3 is a sectional view taken along Line III—III of FIG. 1; and

FIG. 4 is a view, which is similar to FIG. 2, of an enlarged detail.

DETAILED DESCRIPTION OF THE DRAWINGS

FIGS. 1 and 2 partially show a bearing and loading arm 1 of a drafting unit, particularly of a drafting unit for a ring spinning machine. The bearing and loading arm 1 has a U-shaped profile 2. At its not shown end, it is disposed on a supporting rod, which extends in parallel to the bottom rollers of the drafting unit, of which one bottom roller 9 is represented by a dash-dotted line. The bearing and loading arm 1 is guided on the supporting rod in such a manner and is constructed to be rigid in such a manner that it can be swivelled in a plane which extends perpendicularly with respect to the bottom rollers 9. The bearing and loading arm 1 bears several top rollers, of which only one top roller 6 is shown and which, in a corresponding number, are assigned to the bottom rollers. A roving or silver 10 extends between the top roller 6 and the bottom roller 9, and is drafted to the desired yarn size in the drafting unit. For an adaptation of the drafting unit to the fiber material, it is necessary that at least one top roller delimiting the drafting zone is adjustable in moving direction of the silver 10, i.e., in longitudinal direction of the bearing and loading arm 1. In addition, it is important that the top rollers 6 extend as precisely as possible in parallel with respect to the bottom rollers 9. The top rollers 6 are normally constructed as so-called pressure roller twins which consist of two loose rollers which are disposed on a joint shaft 7 held between the two pressure rollers 6.

In the shown embodiment, the shaft 7 of the pressure rollers 6 is arranged in a receiving device 8 which has an approximately semicylindrical recess. The shaft 7 is fixed in this recess by means of a bow spring 11.

The receiving device 8 for the shaft 7 is fastened to a leaf spring 12. In the shown embodiment, the fastening takes place by means of riveting, the bow spring 11 with the leaf spring 12 being at the same time riveted to the receiving device 8.

In the area facing away from the receiving device 8, the leaf spring 12 has a section which is bent in the manner of a hairpin, and to which the part carrying the receiving device 8 is connected by means of a bend at right angles. The leaf spring 12, with the hairpin-shaped section, is fixed in a spring retainer 15 which, in turn, is held in the profile 2 of the bearing and loading arm 1. The spring retainer 15 also has a U-shaped profile which is open in the direction of the bottom rollers 9. A screw 19 is screwed into its transverse web 16 and penetrates the transverse web 3 of the profile 2 in a longitudinal slot, so that the spring retainer 15 can be adjusted and fixed in longitudinal direction of the bearing and loading arm 1.

The leaf spring 12, with the free leg 14 of the hairpin-shaped section, is mounted at the spring retainer 15 in the area of the apex in such a manner that the leaf spring 12, within certain limits, can carry out a swivel movement around a shaft extending transversely with respect to the bearing and loading arm 1. The leaf spring 12 is provided in the area of this transverse shaft with two opposite tabs 22, 23 which are introduced into slot-shaped receiving devices 29 of the legs 17, 18 of the spring retainer 15, these slot-shaped receiving devices 29 being open in downward direction. In the area of these tabs 22, 23, on the bottom side of the leg 14 of the leaf spring 12, a shim 30 is arranged which, from the side, is pushed into corresponding recesses 32 of the legs 17, 18 of the spring retainer 15. This shim 30 is provided with a semicylindrical rib 31, which extends transversely to the bearing and loading arm 1 and which loads the tabs 22, 23 upwards in the direction toward the end of the receiving devices 29. The surfaces 25, 26, which delimit the tabs 22, 23 in longitudinal direction of the bearing and loading arm 1, have such tolerances with respect to the width of the receiving devices 29 that a swivel movement is possible to a certain extent. In order to facilitate the swivel movement, in a modified embodiment, a true swivel bearing may also be provided in this area, for example, in that the area of the receiving devices 29, in which the tabs 22, 23 are in their operative position, is rounded.

As shown particularly in FIG. 4, the tabs 22, 23 are dimensioned such that their front faces 24 project laterally over the legs 17, 18 of the spring retainer 15 and rest against the interior walls of the legs 4, 5 of the profile 2 of the bearing and loading arm 1 and are guided on it. The free end of leg 14 of the leaf spring 12 is provided with two additional tabs 20, 21 which project over the spring retainer 15 in longitudinal direction of the bearing and loading arm 1 and which jut out toward the side corresponding to the tabs 22, 23 and, with their front faces, are also guided on the inner surfaces of the legs 4, 5 of the profile 2. The leaf spring 12 is thus, by means of the tabs 20, 21, 22, 23, guided in transverse direction directly on the inner surfaces of the legs 4, 5 of the profile 2 of the bearing and loading arm 1, i.e., independently of the spring retainer. This alignment between the leaf spring 12 and the bearing and loading arm is not impaired by a releasing and adjusting of the spring retainer 15.

A loading element in the form of a eccentric pin 36 is assigned to the free end of the leg 14 of the hairpin-shaped area of the leaf spring 12, this eccentric pin 36 being provided with two flattened eccentric surfaces 37, 38 which selectively can be brought to rest against the leg 14. The leaf spring 12 is prestressed corresponding to the radius of the eccentric surfaces 37, 38.

A stop is assigned to leg 13 of the leaf spring 12 and is constructed in the shape of a pin 35 arranged between the legs 17, 18. This pin 35 delimits the possible path of the leg 13 of the leaf spring 12 when the bearing and loading arm 1 is swivelled away from the bottom rollers 9.

In order to ensure that deformations or distortions of the leaf spring 12 occurring during the manufacturing of the leaf spring 12 do not impair the alignment of the pressure rollers 6, it is provided that the leaf springs 12 are manufactured first and brought into their final shape. Then the receiving devices 8 are mounted at the leaf springs 12, in which case, the receiving devices 8, in the area of the cylindrical recess for the shafts 7, do not yet have their final shape. The leaf springs 12 are then clamped into an arrangement which has receiving and clamping elements which correspond to the receiving and clamping elements of the bearing and loading arm 1 and of the spring retainer 15. This arrangement is aligned precisely with respect to a tool which subsequently brings the recess of the receiving device 8 into its final shape, so that the recess of the receiving device 8, irrespective of any deformations of the leaf spring 12 caused during the manufacturing, is aligned precisely with respect to the tabs 20, 21, 22, 23 and thus also with respect to the spring retainer 15 and the bearing and loading arm 1.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A bearing and loading arm arrangement for drafting units comprising:

a drafting unit bearing and loading arm, a receiving device for receiving and supporting a drafting unit pressure roller shaft, a leaf spring connected to and supporting the receiving device, said leaf spring being connected to and carried by the bearing and loading arm and serving to load and guide the receiving device, and guide means at the leaf spring and bearing and loading arm for directly transversely aligning the leaf spring with respect to the bearing and loading arm, thereby guiding and aligning the transverse position of the receiving device with respect to the bearing and loading arm with the guiding and aligning of the receiving device occurring only at the leaf spring.

2. A bearing and loading arm arrangement according to claim 1, wherein the leaf spring is fixed in a spring retainer in loading direction and in longitudinal direction of the bearing and loading arm, and wherein the leaf spring supports itself directly at this bearing and loading arm transversely to the bearing and loading arm by way of the guide means.

3. A bearing and loading arm arrangement according to claim 1, wherein the guide means include several jutting-out tabs at the leaf spring which are guided at a distance from one another on lateral guiding surfaces of the bearing and loading arm, said lateral guiding surfaces forming part of the guide means.

4. A bearing and loading arm arrangement according to claim 3, wherein a spring retainer is arranged between lateral guiding surfaces of the bearing and loading arm, and wherein the jutting out tabs at the leaf spring jut out over the spring retainer and are guided on the lateral guiding surfaces of the bearing and loading arm.

5. A bearing and loading arm arrangement according to claim 4, wherein the bearing and loading arm has a U-shaped profile which is open in the direction of the pressure roller twins and the legs of which form the lateral guiding surfaces for the tabs of the leaf spring and between which the also U-shaped spring retainer is arranged.

6. A bearing and loading arm arrangement according to claim 5, wherein the spring retainer is held at the web of the bearing and loading arm by means of a screw guided in a longitudinal slot.

7. A bearing and loading arm arrangement according to claim 2, wherein the spring retainer includes a transverse shaft, and wherein the leaf spring, in the area facing away from the receiving device, has a section which is bent in the shape of a hairpin by means of which it is arranged in the spring retainer, and is held such that, in proximity of the apex, it can be swivelled around a transverse shaft and, in a area of the free leg, is loaded by means of a loading element.

8. A bearing and loading arm arrangement according to claim 7, wherein an adjustable eccentric is provided as the loading element.

9. A bearing and loading arm arrangement according to claim 2, wherein the spring retainer is provided with a stop which limits the path of the leg of the leaf spring which bears the receiving device.

10. A bearing and loading arm arrangement according to claim 1, wherein a springy securing element for the holding of the pressure roller shaft is assigned to the receiving device.

11. A bearing and loading arm arrangement according to claim 3, wherein the leaf spring, in the area facing away from the receiving device, has a section which is bent in the shape of a hairpin by means of which it is arranged in the spring retainer, and is held such that, in proximity of the apex, it can be swivelled around a transverse shaft and, in a area of the free leg, is loaded by means of a loading element.

12. A bearing and loading arm arrangement according to claim 6, wherein the leaf spring, in the area facing away from the receiving device, has a section which is bent in the shape of a hairpin by means of which it is arranged in the spring retainer, and is held such that, in proximity of the apex, it can be swivelled around a transverse shaft and, in a area of the free leg, is loaded by means of a loading element.

13. A bearing and loading arm for drafting units having holding devices for pressure roller twins, which each contain a leaf spring held at the bearing and loading arm by means of a spring retainer, means being provided for moving the spring retainer adjustably in longitudinal direction of the bearing and loading arm, said leaf spring bearing a receiving device for a shaft of the pressure roller twins, wherein the leaf spring is aligned on guides transversely to the longitudinal direction of the bearing and loading arm, and wherein a pair of opposite tabs are guided in recesses of the spring retainer which extend transversely with respect to the longitudinal direction of the bearing and loading arm.

14. A bearing and loading arm according to claim 3, wherein the tabs of the leaf spring are secured in the recesses of the spring retainer by means of a shim.

15. A bearing and loading arm for drafting units having holding devices for pressure roller twins, which each contain a leaf spring held at the bearing and loading arm by means of a spring retainer, means being provided for moving the spring retainer adjustably in longitudinal direction of the bearing and loading arm, said leaf spring bearing a receiving device for a shaft of the pressure roller twins, wherein the leaf spring is aligned on guides transversely to the longitudinal direction of the bearing and loading arm, and wherein the receiving device for the shaft of the pressure roller twins is subjected to at least a finishing after the mounting on the leaf spring.

16. A bearing and loading arm for drafting units having holding devices for pressure roller twins, which each contain a leaf spring held at the bearing and loading arm by means of a spring retainer, means being provided for moving the spring retainer adjustably in longitudinal direction of the bearing and loading arm, said leaf spring bearing a receiving device for a shaft of the pressure roller twins, wherein the leaf spring is aligned on guides transversely to the longitudinal direction of the bearing and loading arm, wherein the leaf spring, in the area facing away from the receiving device, has a section which is bent in the shape of a hairpin by means of which it is arranged in the spring retainer, and is held such that, in proximity of the apex, it can be swivelled around a transverse shaft and, in the area of the free leg, is loaded by means of a loading element, and wherein an adjustable eccentric is provided as the loading element.

17. A bearing and loading arm according to claim 16, wherein the spring retainer is provided with a stop which limits the path of the leg of the leaf spring which bears the receiving device.

18. A bearing and loading arm according to claim 17, wherein a pair of opposite tabs are guided in recesses of the spring retainer which extend transversely with respect to the longitudinal direction of the bearing and loading arm.

19. A bearing and loading arm according to claim 18, wherein the tabs of the leaf spring are secured in the recesses of the spring retainer by means of a shim.

20. A bearing and loading arm according to claim 19, wherein a springy securing element for the holding of the shaft is assigned to the receiving device.

* * * * *